US011542739B1

(12) United States Patent
Liao

(10) Patent No.: US 11,542,739 B1
(45) Date of Patent: Jan. 3, 2023

(54) DOOR CLOSER MECHANISM

(71) Applicant: Shern Dar Indusrial Corp., New Taipei (TW)

(72) Inventor: Jui Chung Liao, Humboldt, IA (US)

( * ) Notice: Subject to any disclaimer, the term of this patent is extended or adjusted under 35 U.S.C. 154(b) by 0 days.

(21) Appl. No.: 17/500,734

(22) Filed: Oct. 13, 2021

(51) Int. Cl.
*E05F 3/00* (2006.01)
*E05F 3/02* (2006.01)

(52) U.S. Cl.
CPC ..... *E05F 3/02* (2013.01); *E05Y 2201/21* (2013.01); *E05Y 2201/246* (2013.01); *E05Y 2201/454* (2013.01); *E05Y 2201/456* (2013.01); *E05Y 2201/484* (2013.01); *E05Y 2900/132* (2013.01)

(58) Field of Classification Search
CPC ..... Y10T 16/53822; Y10T 16/5383; Y10T 16/53834; Y10T 16/5384; Y10T 16/5389; Y10T 16/304; E05F 1/1246; E05F 1/1253; E05F 1/1261; E05F 3/02; E05F 3/04; E05D 3/18; E05D 3/183; E05D 7/00; E05D 7/0009; E05D 7/0415; E05D 7/0423; E05Y 2201/21; E05Y 2201/454; E05Y 2201/456; E05Y 2201/484; E05Y 2201/496; E05Y 2201/638; E05Y 2900/20; E05Y 2900/132
See application file for complete search history.

(56) References Cited

U.S. PATENT DOCUMENTS 4,185,415 A * 1/1980 LaConte ..... E05D 3/06 49/248
4,709,445 A 12/1987 Waldo et al.
5,079,797 A * 1/1992 Ohshima ..... E05C 17/345 16/DIG. 9
5,220,706 A 6/1993 Bivens
5,272,789 A * 12/1993 Mitchell ..... E05F 1/1284 16/278
5,471,708 A 12/1995 Lynch
5,829,508 A 11/1998 DeBower et al.
5,882,099 A * 3/1999 Salice ..... E05D 15/262 312/328
6,725,503 B1 4/2004 Lin
7,231,692 B2 * 6/2007 Harada ..... E05D 3/18 220/835
7,721,388 B2 * 5/2010 Lee ..... E05F 1/1276 16/322
9,009,917 B2 * 4/2015 Chao ..... E05F 1/1091 16/72
10,914,106 B2 * 2/2021 Salice ..... E05F 3/104
(Continued)

FOREIGN PATENT DOCUMENTS

GB 1364760 A * 8/1974 ..... E05F 1/1261
JP 2011026817 A * 2/2011

*Primary Examiner* — Chuck Y Mah
(74) *Attorney, Agent, or Firm* — Browdy and Neimark, PLLC

(57) ABSTRACT

A door closer mechanism includes a base attached to a door frame, a housing attached to a door panel and a groove formed in the housing, a lever includes one end slidably engaged with the base and another end connected to the housing with a pivot axle, a rotary member is pivotally connected to the housing with the pivot axle, a shaft is slidably engaged in the housing and pivotally connected to the rotary member with a pivot pin, and a spring biasing member is disposed in the housing and engaged with the shaft for applying a spring biasing force onto the shaft and for biasing the shaft toward one end portion of the channel of the base.

15 Claims, 9 Drawing Sheets

(56) References Cited

U.S. PATENT DOCUMENTS

| | | | | |
|---|---|---|---|---|
| 11,118,389 | B2 * | 9/2021 | Kashiwaguma | E05F 1/105 |
| 2001/0039762 | A1 * | 11/2001 | Giovannetti | E05F 1/1091 49/246 |
| 2005/0091928 | A1 * | 5/2005 | Okulov | E05F 15/74 49/341 |
| 2006/0038412 | A1 * | 2/2006 | Muramatsu | E05F 1/1215 292/144 |
| 2010/0109497 | A1 * | 5/2010 | Blersch | E05D 15/408 312/405 |
| 2010/0127606 | A1 * | 5/2010 | Collene | E05F 1/1292 16/68 |
| 2012/0317883 | A1 * | 12/2012 | Yamaguchi | E05F 1/14 49/358 |
| 2019/0169902 | A1 * | 6/2019 | Hu | E05F 1/14 |
| 2020/0018092 | A1 * | 1/2020 | Schappler | E05B 9/02 |
| 2021/0025209 | A1 * | 1/2021 | Kashiwaguma | E05F 5/027 |
| 2021/0172229 | A1 * | 6/2021 | Oshima | E05F 1/1246 |
| 2021/0293070 | A1 * | 9/2021 | Terenzi | E05F 1/1276 |

* cited by examiner

DOOR CLOSER MECHANISM

BACKGROUND OF THE INVENTION

1. Field of the Invention

The present invention relates to a door closer mechanism, and more particularly to a door closer mechanism including an improved structure or configuration for allowing the door closer mechanism to be easily made or manufactured, and to be easily and effectively actuated or operated.

2. Description of the Prior Art

As is generally known in the art, if an openable object is allowed to abruptly open relative to its main body the impact between them may not only cause damage to occur possibly destroying both of them, but can also produce vibration and noise to render the contents stored within the openable object to fall out and become scattered. For example, when the openable object is a glove compartment door installed in the interior of a closet the sudden impact opening will cause the items therein to be tossed or thrown all over the house family. In order to avoid this type of problem, there has been provided in the prior art door damper devices for absorbing the impact created between the main body and the openable object.

For example, U.S. Pat. No. 4,709,445 to Waldo et al., U.S. Pat. No. 5,220,706 to Bivens, U.S. Pat. No. 5,471,708 to Lynch, U.S. Pat. No. 5,829,508 to DeBower et al., and U.S. Pat. No. 6,725,503 B1 to Lin disclose several of the typical door closer mechanisms each comprising an air damper or hydraulic cylinder or the like to be connected or coupled between the door frame and the door panel for resisting or damping the movement of the door panel toward the door frame.

However, the typical door closer mechanisms normally comprise a complicated structure or configuration that may not be easily made or manufactured, and also may not be easily operated by the users.

The present invention has arisen to mitigate and/or obviate the afore-described disadvantages of the conventional door closer mechanisms.

SUMMARY OF THE INVENTION

The primary objective of the present invention is to provide a door closer mechanism including an improved structure or configuration for allowing the door closer mechanism to be easily made or manufactured, and to be easily and effectively actuated or operated.

In accordance with one aspect of the invention, there is provided a door closer mechanism comprising a base to be attached to a door frame, the base including a channel formed in the base, a damper device including a housing to be attached to a door panel, the housing including a groove formed in the housing, a lever including a first end portion slidably engaged into the channel of the base and movable along the channel of the base, the lever including a second end portion pivotally connected to the housing with a pivot axle, the channel of the base including a first end portion and a second end portion, a rotary member pivotally connected to the housing with the pivot axle, a shaft slidably received and engaged in the groove of the housing, and pivotally connected to the rotary member with a pivot pin, and a spring biasing member disposed in the housing and engaged with the shaft for applying a spring biasing force onto the shaft and for biasing the shaft toward the first end portion of the channel of the base and for moving the lever relative to the housing and for allowing the door closer mechanism to be effectively operated.

The channel of the base is a curved channel for slidably receiving the first end portion of the lever. The housing includes a lock recess formed in the housing at the second end portion of the groove and communicating with the groove of the housing for engaging with the shaft and for locking and retaining the shaft in the housing.

The spring biasing member includes a first end portion engaged with the shaft, and includes a second end portion, and a follower slidably received and engaged in the housing and engaged with the second end portion of the spring biasing member for adjusting the spring biasing force of the spring biasing member to the shaft. A screw may further be provided and rotatably attached to the housing, and the follower is engaged with the screw for allowing the follower to be moved along the screw when the screw is rotated relative to the housing.

A damper member may further be provided and includes a cylinder connected to the housing, and a piston connected to the lever for resisting or damping the rotational movement of the lever relative to the housing. The housing includes a beam extended from the housing, and the cylinder is rotatably attached to the beam. The piston is rotatably connected to a middle portion of the lever. The lever includes a notch formed in the second end portion of the lever, and the shaft is engaged in the notch of the lever.

The shaft includes a stud extended from the shaft, and the pivot pin is extended from the stud and rotatably connected to the rotary member. The rotary member includes a projection extended from the rotary member, and the pivot pin is engaged with the projection. The lever includes a roller provided on the first end portion of the lever and engaged into the channel of the base.

A cover may further be provided and secured to the housing, the cover includes a slot aligned with the groove of the housing, and the shaft is slidably received and engaged in the slot of the cover. The slot of the cover is a curved slot. The slot of the cover includes a first end portion and a second end portion, and a lock recess formed in the cover at the second end portion of the slot and communicating with the slot of the cover.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
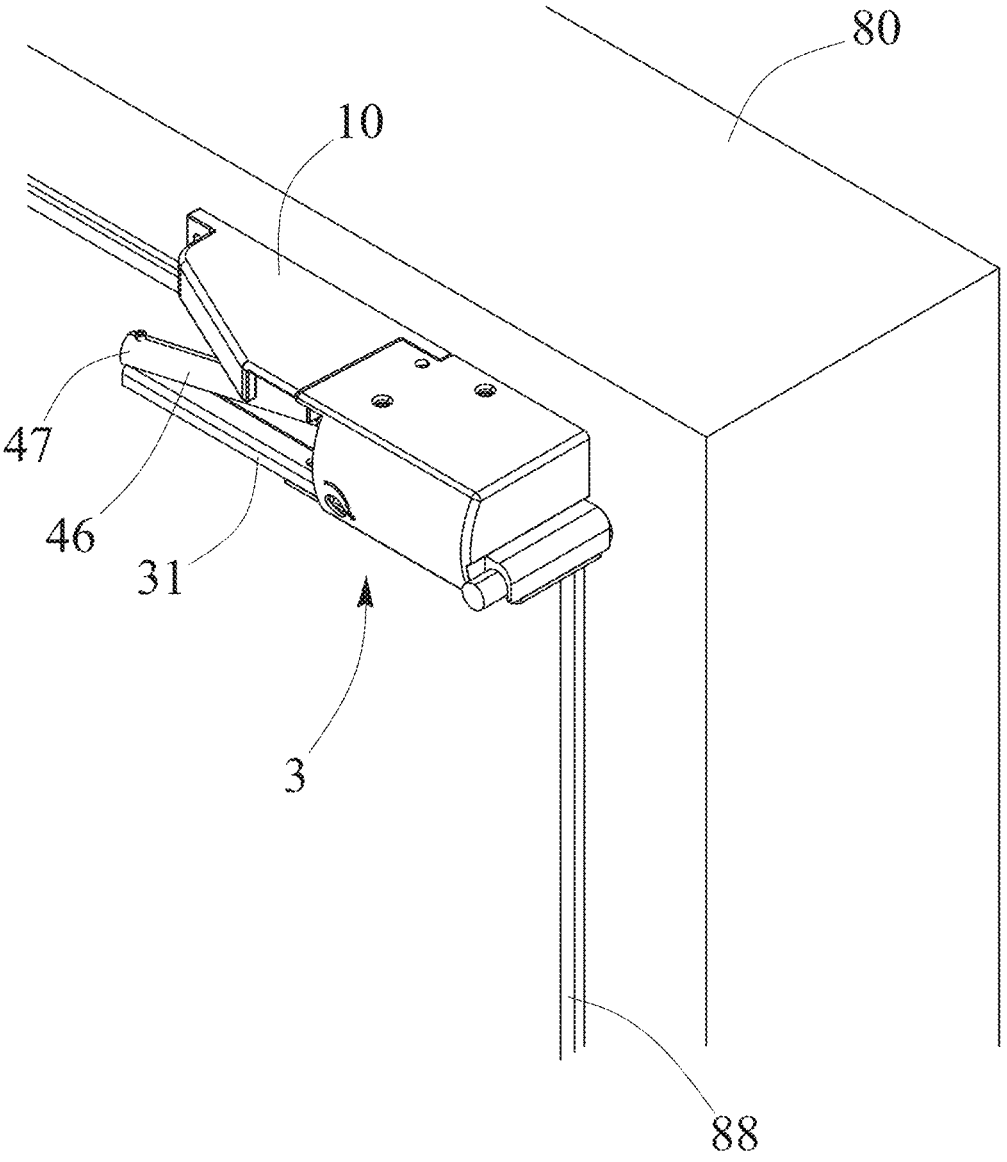
FIG. 1 is a partial perspective view of a door closer mechanism in accordance with the present invention.
Figure 2:
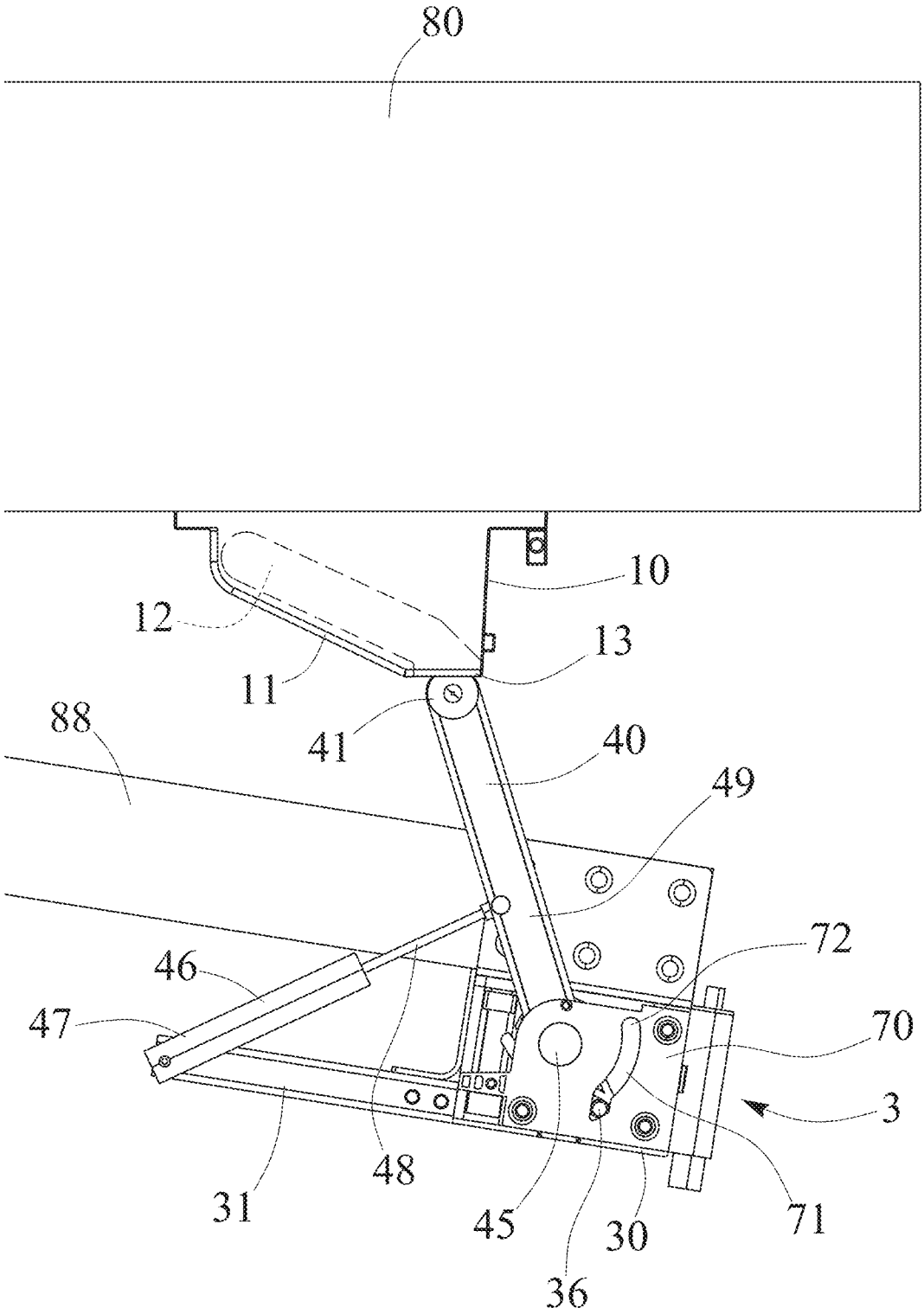
FIG. 2 is a partial top plan schematic view of the door closer mechanism.

Referring to the drawings, and initially to FIGS. 1 and 2, a door closer mechanism in accordance with the present invention is to be attached or mounted or secured to a door frame 80 and a door panel 88, for example, the door closer mechanism comprises a seat or base 10 attached or mounted or secured to the door frame 80 (FIGS. 1-2 and 7-10), and a bumper or damper device 3 to be attached or mounted or secured to the door panel 88 and connected or coupled to the base 10 for resisting or damping the movement of the door panel 88 toward the door frame 80. The base 10 includes a tilted or inclined outer portion 11, and a groove or channel 12 formed or provided in the base 10, and preferably within or at the outer portion 11 of the base 10, and the channel 12 of the base 10 includes an outlet or opening 13 formed in the base 10 and communicating with the channel 12 of the base 10 and opened outwardly.

As shown in FIGS. 1-6, the damper device 3 includes a carrier or housing 30 to be attached or mounted or secured to the door panel 88, and an extension bar or beam 31 attached or mounted or secured to or extended from the housing 30, and a link or lever 40 to be connected or coupled between the housing 30 and the base 10, for example, the lever 40 includes a wheel or roller 41 formed or provided on one or first end portion 42 of the lever 40 and to be engaged into the channel 12 of the base 10 through the opening 13 of the base 10, and to be slidably received or engaged in the channel 12 of the base 10. The lever 40 includes another or second end portion 43 having a notch 44 formed therein and opened outwardly, and the lever 40 is pivotally or rotatably connected or coupled to the housing 30 with a pivot axle 45 at the other or second end portion 43 of the lever 40.

Figure 3:
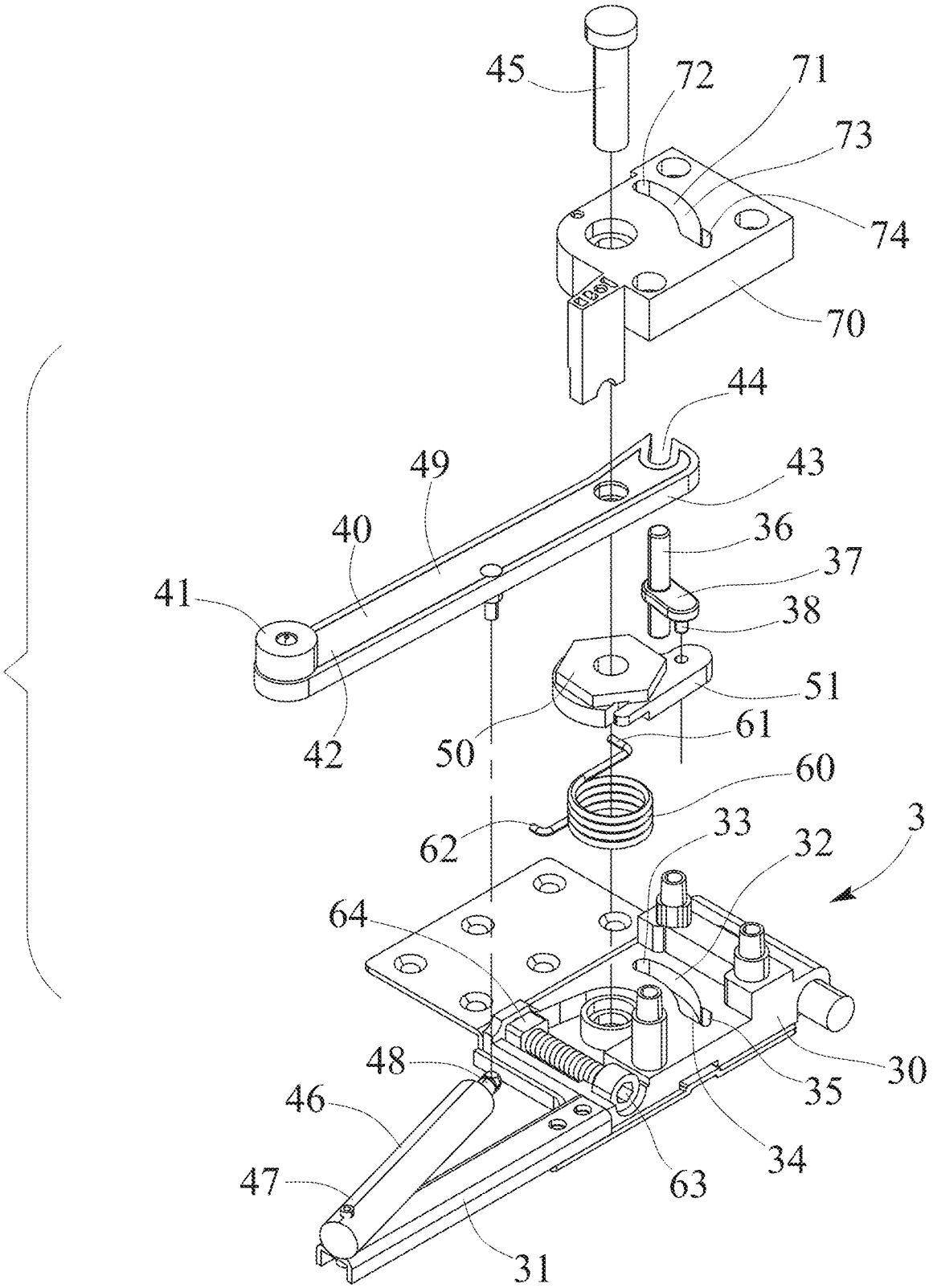
FIG. 3 is a partial exploded view of the door closer mechanism.

A hydraulic cylinder or air damper member 46 or the like is to be connected or coupled between the lever 40 and the housing 30, for example, the damper member 46 includes a cylinder 47 pivotally or rotatably connected or coupled to the beam 31 of the housing 30, and a sliding member or piston 48 pivotally or rotatably connected or coupled to the lever 40 at the middle or intermediate portion 49 of the lever 40 for resisting or damping the rotational movement of the lever 40 relative to the housing 30, As shown in FIG. 3, a follower or rotary member 50 is also pivotally or rotatably connected or coupled to the housing 30 with the pivot axle 45 and includes an extension or projection 51 extended therefrom.

As shown in FIGS. 3-6, the housing 30 includes a slot or groove 32, such as a curved groove 32 formed therein and having one or first end portion 33 and another or second end portion 34, and a lock notch or recess 35 formed in the housing 30 at the other or second end portion 34 of the groove 32 and communicating with the groove 32 of the housing 30. A pole or shaft 36 is slidably received or engaged in the groove 32 of the housing 30 and includes an extension or projection or stud 37 extended therefrom and pivotally or rotatably connected or coupled to the rotary member 50 at the projection 51 of the rotary member 50 with a pivot pin 38. A spring biasing member 60, such as a coil spring 60 is disposed in the housing 30 and engaged onto the pivot axle 45, and includes one or first end portion 61 contacted or engaged with the shaft 36 for applying a spring biasing force onto or against the shaft 36, and includes another or second end portion 62.

Figure 4:
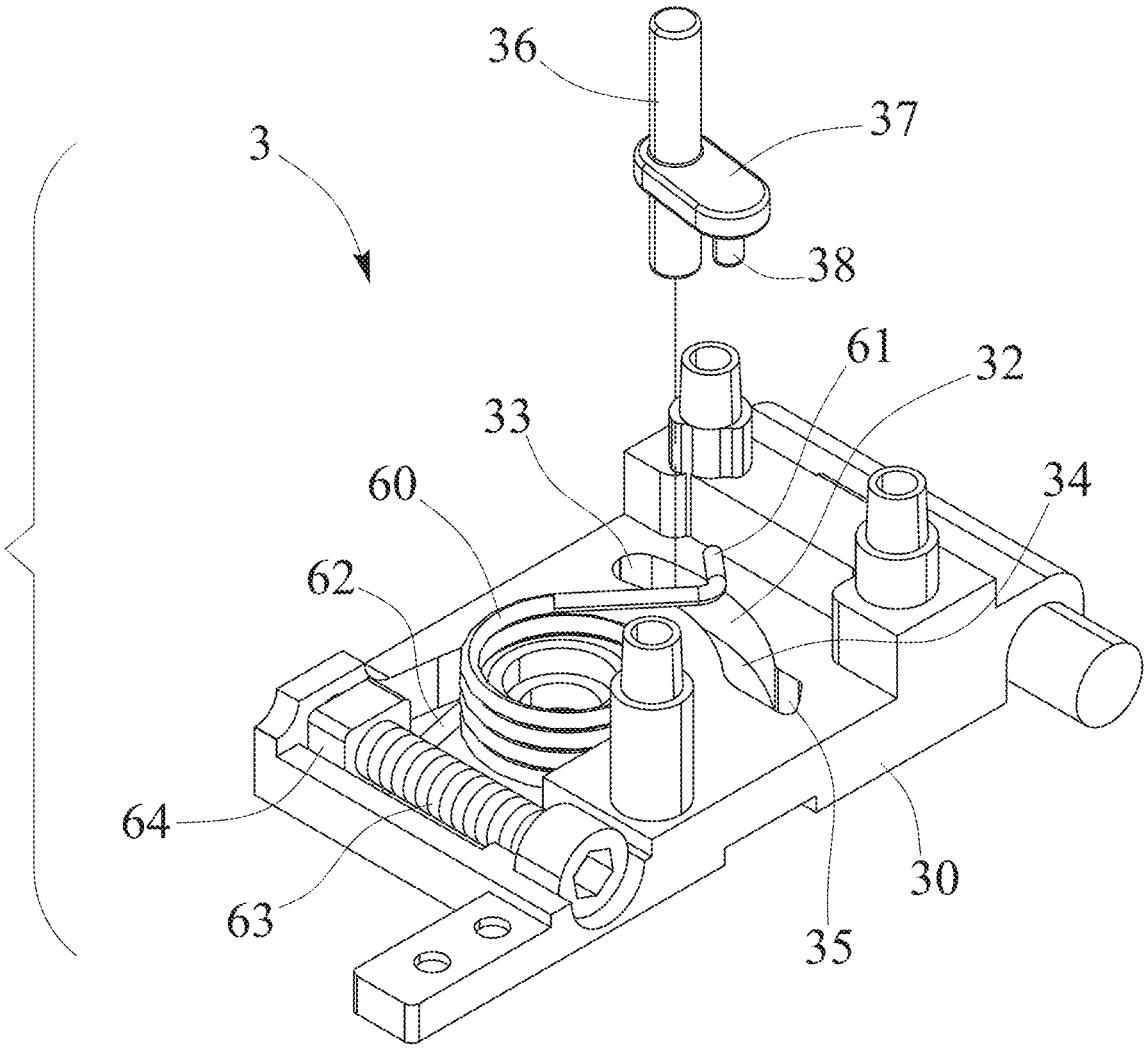
FIG. 4 is another partial exploded view of the door closer mechanism.
Figure 5:
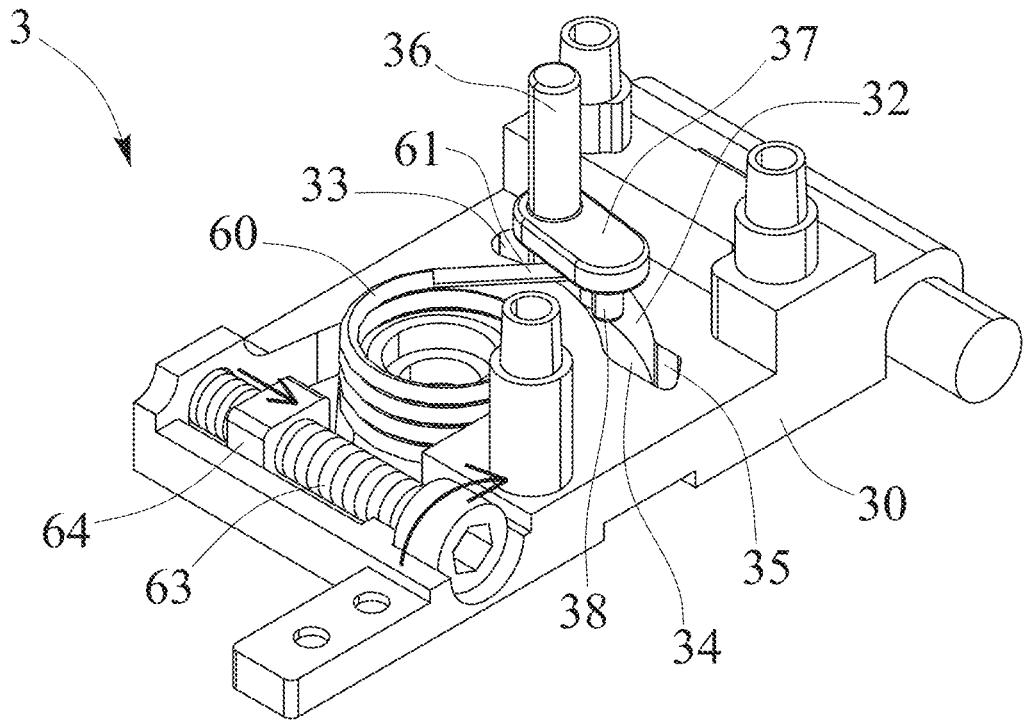
FIG. 5 is another partial perspective view of the door closer mechanism.
Figure 6:
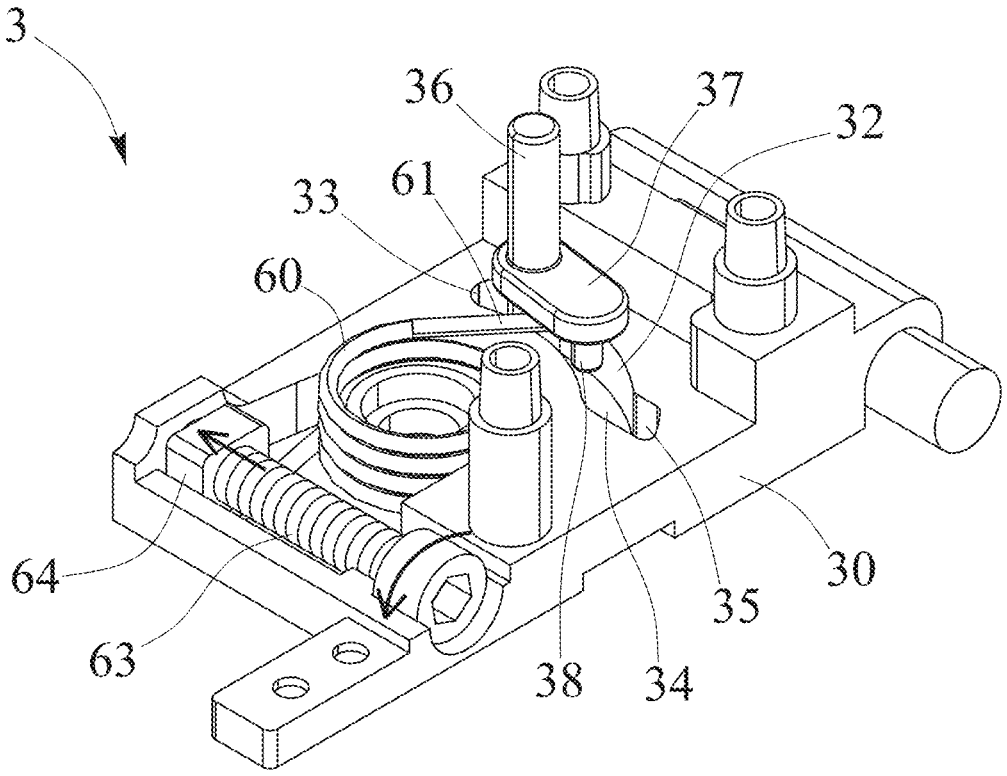
FIG. 6 is a further partial perspective view similar to FIG. 5, illustrating the operation of the door closer mechanism.

As shown in FIGS. 4-6, a bolt or screw 63 is pivotally or rotatably attached or mounted or secured to the housing 30, and a nut or follower 64 is engaged with the screw 63 for moving the nut or follower 64 along or relative to the screw 63, and the follower 64 is contacted or engaged with the other or second end portion 62 of the spring biasing member 60 for adjusting the spring biasing force of the spring biasing member 60 onto or against the shaft 36, for example, the follower 64 may be forced to move along or relative to the screw 63 when the screw 63 is pivoted or rotated or driven relative to the housing 30 by the user, in order to adjust the spring biasing force of the spring biasing member 60 onto or against the shaft 36.

As shown in FIGS. 2-3, a shield or cover 70 may further be provided and attached or mounted or secured to the housing 30 for retaining the parts or elements within the housing 30, the cover 70 also includes a groove or slot 71, such as a curved slot 71 formed therein and aligned with the groove 32 of the housing 30, and having one or first end portion 72 and another or second end portion 73, and a lock notch or recess 74 formed in the cover 70 at the other or second end portion 73 of the slot 71 and communicating with the slot 71 of the cover 70 for slidably receiving or engaging with the shaft 36.

Figure 7:
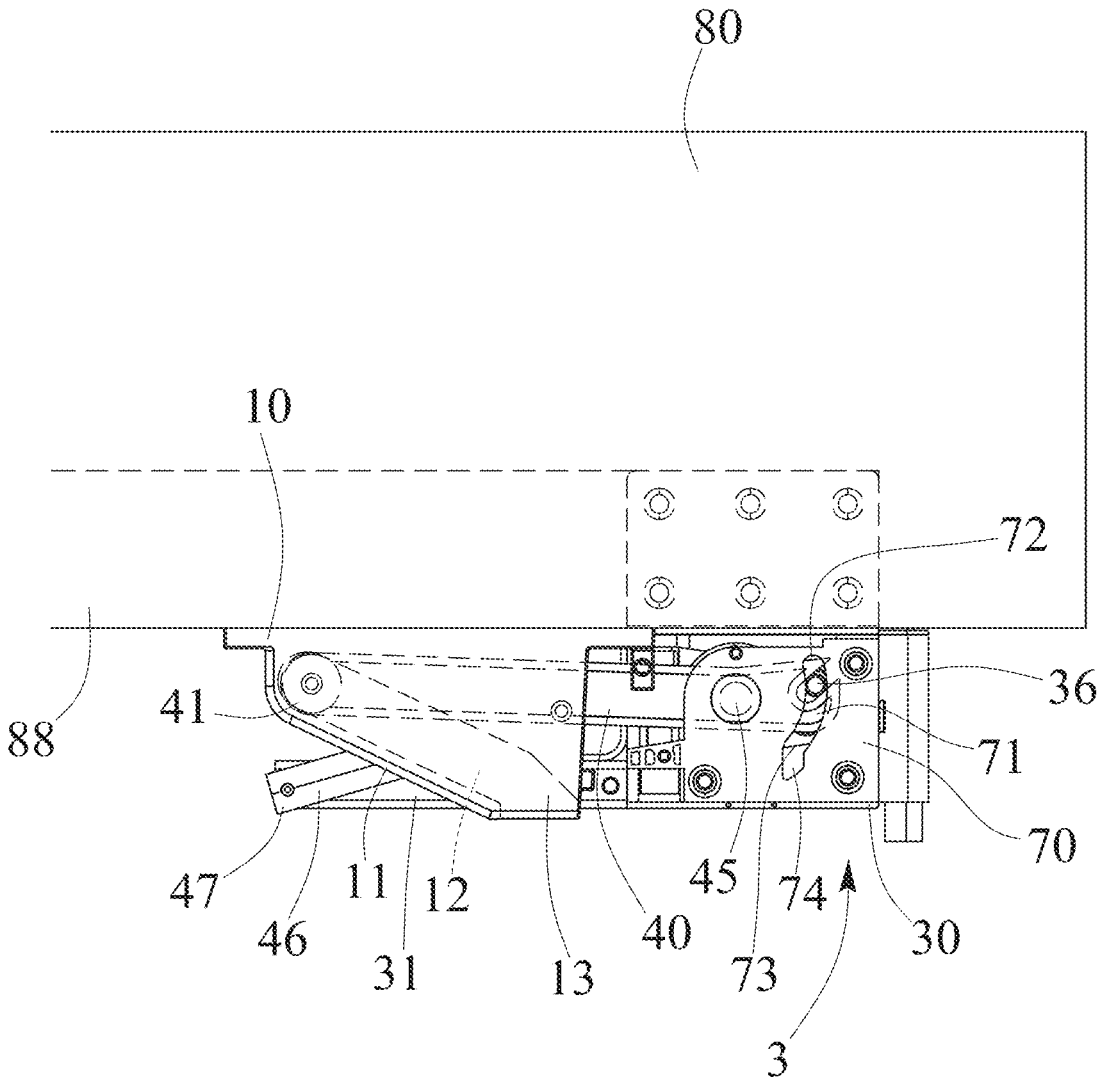
FIGS. 7, 8, 9, 10 are partial top plan schematic views similar to FIG. 2, illustrating the operation of the door closer mechanism.
Figure 8:
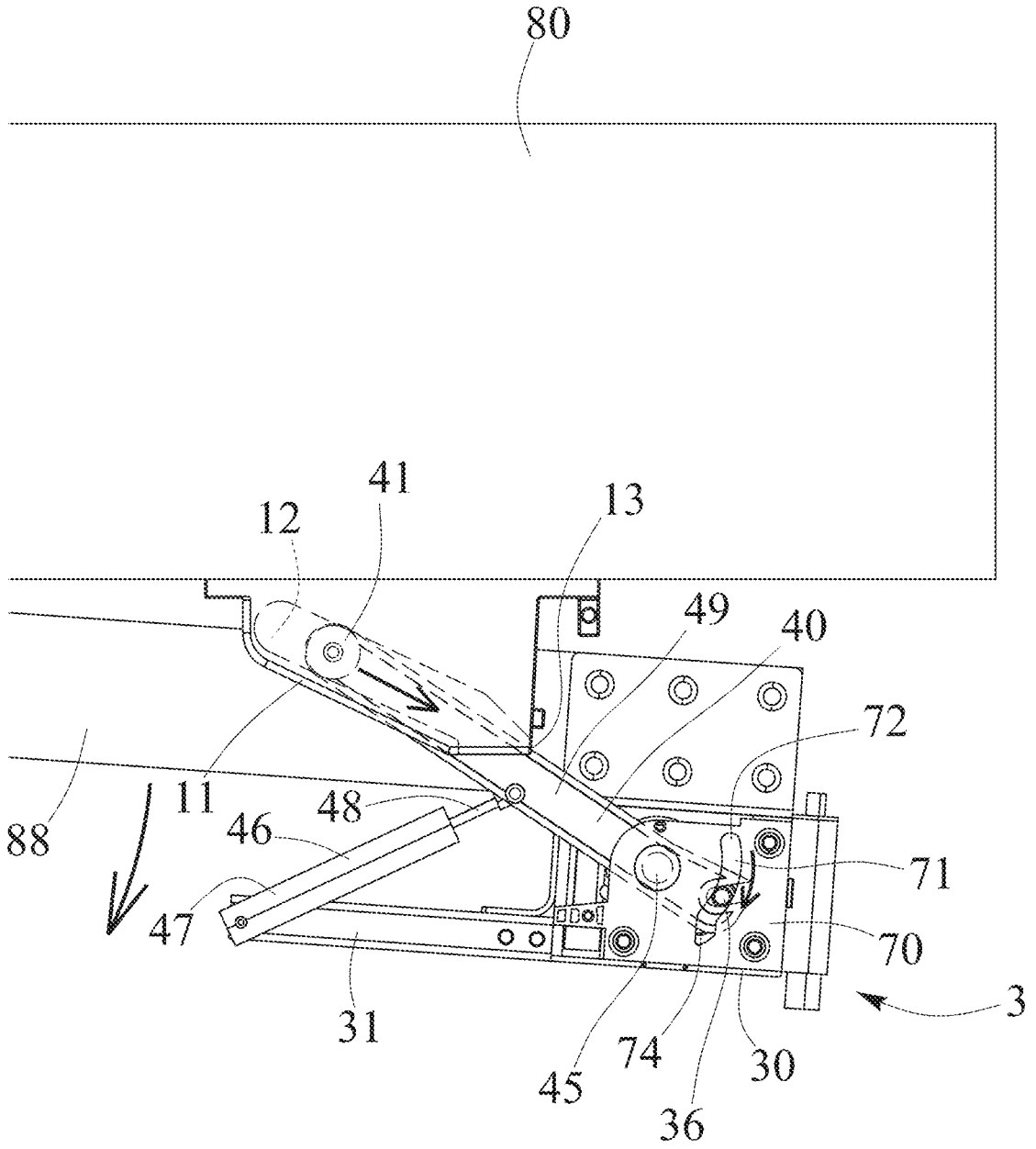
Figure 9:
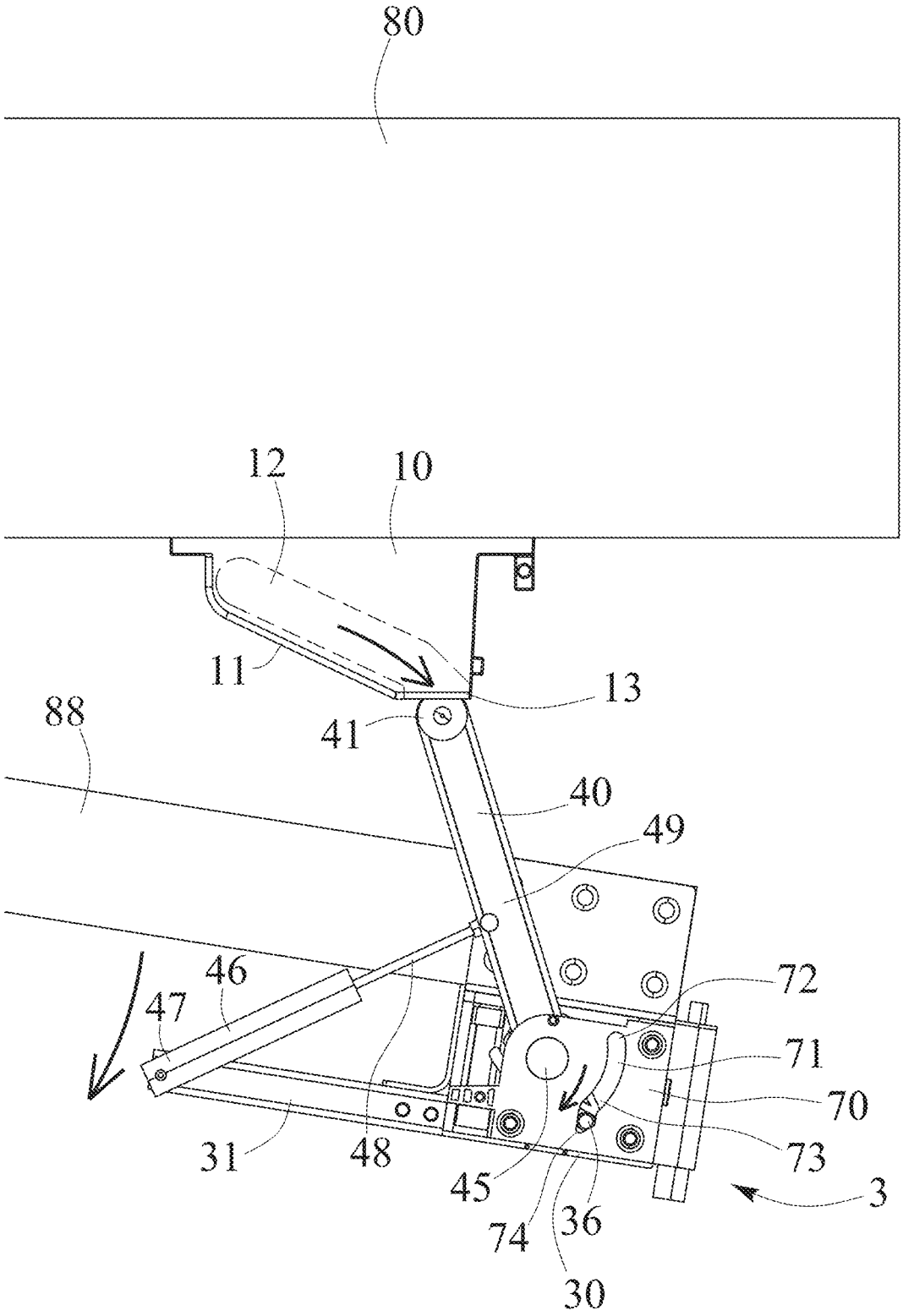

In operation, as shown in FIG. 7, illustrated is the door panel 88 at a closed position relative to the door frame 80 wherein the roller 41 is engaged into the channel 12 of the base 10, and the shaft 36 is biased and forced toward the one or first end portion 33 of the groove 32 of the housing 30 and also toward the one or first end portion 72 of the slot 71 of the cover 70. As shown in FIG. 8, when the door panel 88 is opened relative to the door frame 80 or moved away from the door frame 80, the roller 41 will be moved along the channel 12 of the base 10, and the shaft 36 will be forced to move along the groove 32 of the housing 30 and the slot 71 of the cover 70. As shown in FIG. 9, when the door panel 88 is opened and moved away from the door frame 80 toward the outermost position, the shaft 36 will be forced to move into the lock recess 35 of the housing 30 and also the lock recess 74 of the cover 70. The roller 41 may be selectively moved out of the channel 12 of the base 10.

Figure 10:
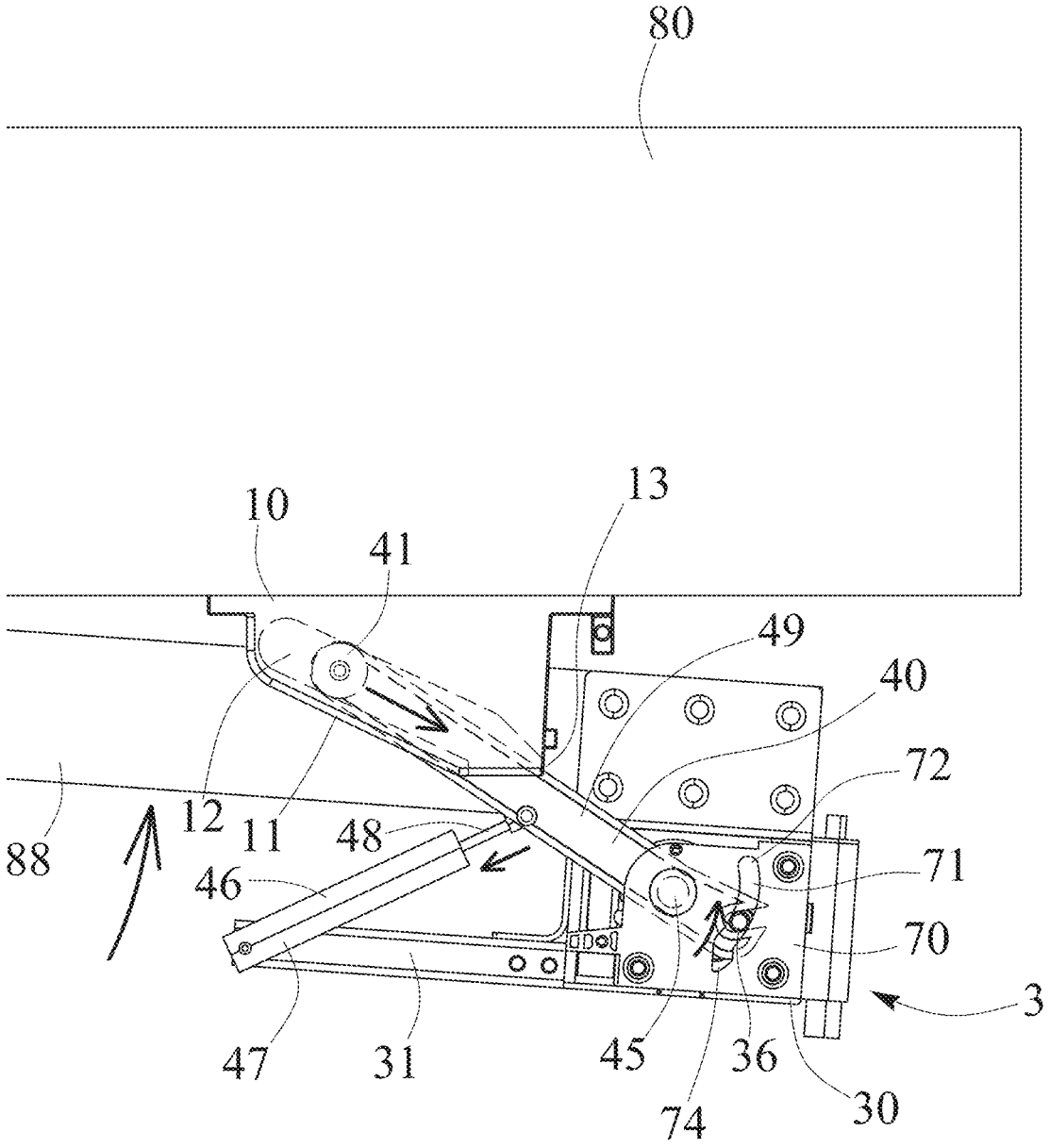

When the shaft 36 is engaged with the lock recess 35 of the housing 30 and/or the lock recess 74 of the cover 70, the spring biasing member 60 may not force the shaft 36 to move along the groove 32 of the housing 30 and the slot 71 of the cover 70. As shown in FIG. 10, when the door panel 88 is moved toward the door frame 80, the shaft 36 will be forced to move out of the lock recess 35 of the housing 30 and the lock recess 74 of the cover 70, and the spring biasing member 60 may then force the shaft 36 to move along the groove 32 and toward the one or first end portion 33 of the groove 32 of the housing 30 and toward the one or first end portion 72 of the slot 71 of the cover 70. At this moment, the damper member 46 may be provided for resisting or damping the rotational movement of the lever 40 relative to the housing 30 and also for resisting or damping the movement of the door panel 88 relative to the door frame 80.

Accordingly, the door closer mechanism in accordance with the present invention includes an improved structure or configuration for allowing the door closer mechanism to be easily made or manufactured, and to be easily and effectively actuated or operated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A door closer mechanism comprising:

a base to be attached to a door frame, said base including a channel formed in said base, a damper device including a housing to be attached to a door panel, said housing including a groove formed in said housing, said groove of said housing including a first end portion and a second end portion, a lever including a first end portion slidably engaged into said channel of said base and movable along said channel of said base, said lever including a second end portion pivotally connected to said housing with a pivot axle, a rotary member pivotally connected to said housing with said pivot axle, a shaft slidably received and engaged in said groove of said housing, and pivotally connected to said rotatory member with a pivot pin, and a spring biasing member disposed in said housing and engaged with said shaft for applying a spring biasing force onto said shaft and for biasing said shaft toward said first end portion of said groove of said housing.

2. The door closer mechanism as claimed in claim 1, wherein said groove of said housing is a curved groove.

3. The door closer mechanism as claimed in claim 1, wherein said housing includes a lock recess formed in said housing at said second end portion of said groove and communicating with said groove of said housing for engaging with said shaft.

4. The door closer mechanism as claimed in claim 1, wherein said spring biasing member includes a first end portion engaged with said shaft, and includes a second end portion, and a follower slidably received and engaged in said housing and engaged with said second end portion of said spring biasing member.

5. The door closer mechanism as claimed in claim 4, wherein a screw is rotatably attached to said housing, and said follower is engaged with said screw for allowing said follower to be moved along said screw when said screw is rotated relative to said housing.

6. The door closer mechanism as claimed in claim 1, wherein a damper member includes a cylinder connected to said housing, and a piston connected to said lever.

7. The door closer mechanism as claimed in claim 6, wherein said housing includes a beam extended from said housing, and said cylinder is rotatably attached to said beam.

8. The door closer mechanism as claimed in claim 6, wherein said piston is rotatably connected to a middle portion of said lever.

9. The door closer mechanism as claimed in claim 1, wherein said lever includes a notch formed in said second end portion of said lever, and said shaft is engaged in said notch of said lever.

10. The door closer mechanism as claimed in claim 1, wherein said shaft includes a stud extended from said shaft, and said pivot pin is extended from said stud and rotatably connected to said rotary member.

11. The door closer mechanism as claimed in claim 1, wherein said rotary member includes a projection extended from said rotary member, and said pivot pin is engaged with said projection.

12. The door closer mechanism as claimed in claim 1, wherein a cover is secured to said housing, said cover includes a slot aligned with said groove of said housing, and said shaft is slidably received and engaged in said slot of said cover.

13. The door closer mechanism as claimed in claim 12, wherein said slot of said cover is a curved slot.

14. The door closer mechanism as claimed in claim 12, wherein said slot of said cover includes a first end portion and a second end portion, and a lock recess formed in said cover at said second end portion of said slot and communicating with said slot of said cover.

15. The door closer mechanism as claimed in claim 1, wherein said lever includes a roller provided on said first end portion of said lever and engaged into said channel of said base.

* * * * *